US007757412B2

(12) United States Patent
Farys

(10) Patent No.: US 7,757,412 B2
(45) Date of Patent: Jul. 20, 2010

(54) FOOTWEAR WITH IMPROVED HEEL SUPPORT

(75) Inventor: Yves Farys, Saint-Jorioz (FR)

(73) Assignee: Salomon S.A.S., Metz-Tessy (FR)

( * ) Notice: Subject to any disclaimer, the term of this patent is extended or adjusted under 35 U.S.C. 154(b) by 936 days.

(21) Appl. No.: 11/519,066

(22) Filed: Sep. 12, 2006

(65) Prior Publication Data

US 2007/0068041 A1 Mar. 29, 2007

(30) Foreign Application Priority Data

Sep. 28, 2005 (FR) ..... 05 09918

(51) Int. Cl.
*A43C 11/12* (2006.01)
*A43B 23/08* (2006.01)

(52) U.S. Cl. ..... 36/50.1; 36/69; 36/58.6

(58) Field of Classification Search ..... 36/50.1, 36/69, 58.6, 76 HH, 58.5
See application file for complete search history.

(56) References Cited

U.S. PATENT DOCUMENTS

| | | | | |
|---|---|---|---|---|
| 2,806,300 | A | | 9/1957 | Morgan, Jr. et al. |
| 4,615,127 | A | | 10/1986 | Delery |
| 4,766,681 | A | * | 8/1988 | O'Rourke et al. ..... 36/89 |
| 4,972,613 | A | * | 11/1990 | Loveder ..... 36/105 |
| 5,408,761 | A | * | 4/1995 | Gazzano ..... 36/88 |
| 5,477,593 | A | | 12/1995 | Leick |
| 5,819,440 | A | * | 10/1998 | Okajima ..... 36/117.1 |
| 5,901,469 | A | * | 5/1999 | Saillet ..... 36/118.2 |
| 6,018,892 | A | * | 2/2000 | Acheson et al. ..... 36/89 |
| 2004/0074110 | A1 | | 4/2004 | Borsoi |

FOREIGN PATENT DOCUMENTS

| | | |
|---|---|---|
| FR | 2 499 834 A1 | 8/1982 |
| FR | 2 534 116 A1 | 4/1984 |
| FR | 2 706 743 A1 | 12/1994 |

* cited by examiner

*Primary Examiner*—Ted Kavanaugh
(74) *Attorney, Agent, or Firm*—Greenblum & Bernstein, P.L.C.

(57) ABSTRACT

An article of footwear including a sole and an upper, the upper including a seat adapted to nest the user's heel, the seat including a first stiffener, and an arrangement for varying the size or volume of the seat provided by the first stiffener, between an expanded position, for which the volume of the seat is relatively large, and a retracted position, for which the volume of the seat is reduced.

18 Claims, 6 Drawing Sheets

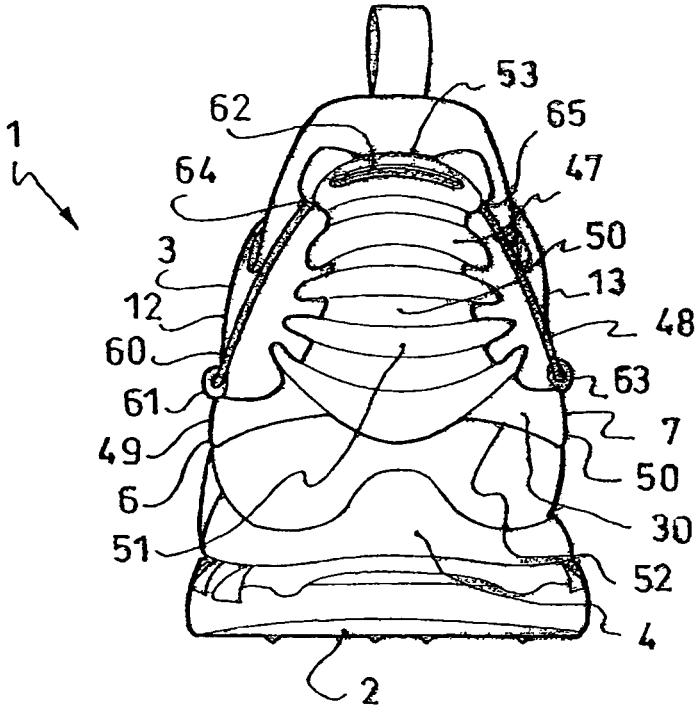
Fig. 2
Fig. 4
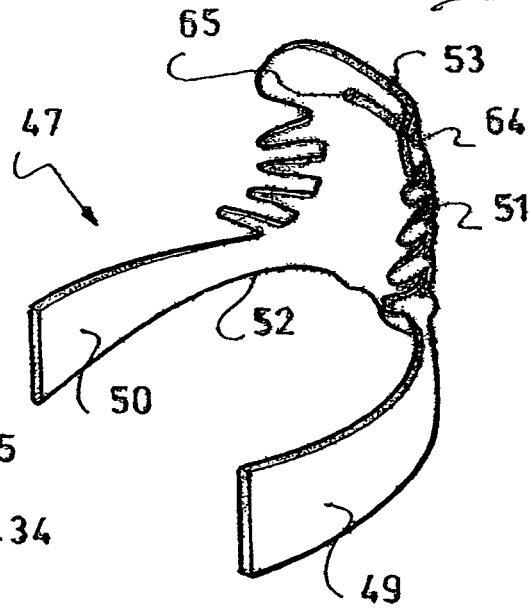
Fig. 3
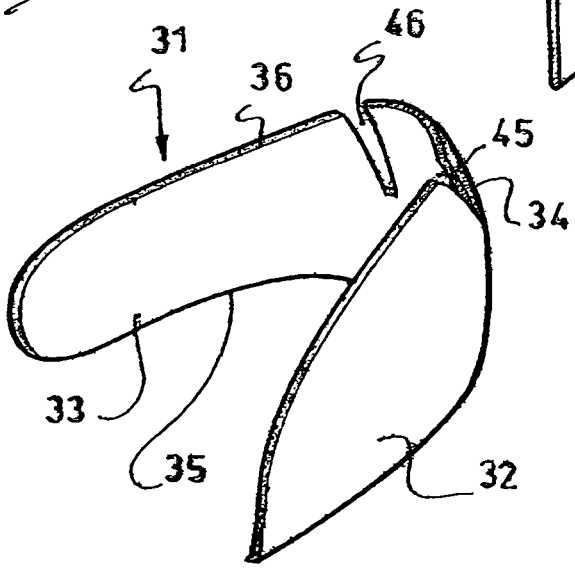

Fig: 9
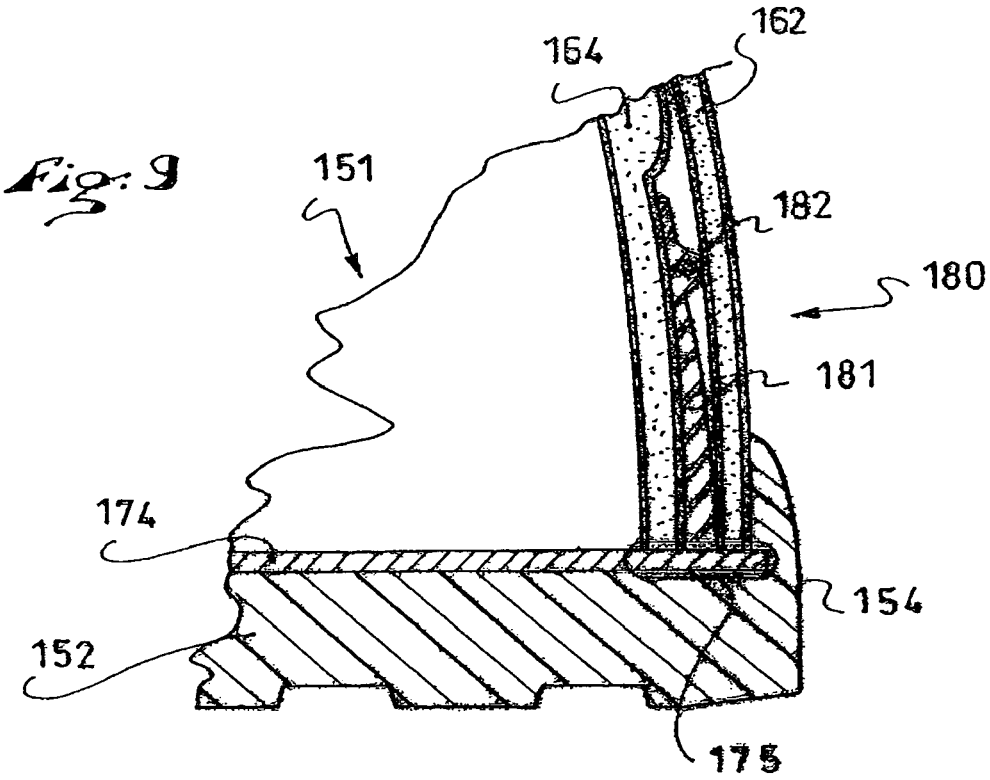
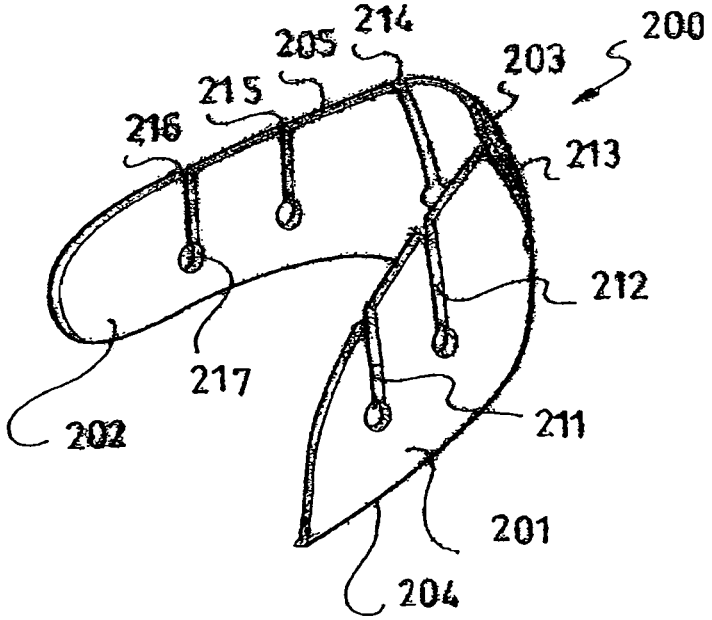
Fig: 10

FOOTWEAR WITH IMPROVED HEEL SUPPORT

CROSS-REFERENCE TO RELATED APPLICATION

This application claims priority under 35 U.S.C. §119 of French Patent Application No. 05.09918, filed on Sep. 28, 2005, the disclosure of which is hereby incorporated by reference thereto in its entirety.

BACKGROUND OF THE INVENTION

1. Field of the Invention

The invention relates to an article of footwear, such as a shoe, particularly a sports shoe, and more particularly a shoe adapted for athletics or race walking, and/or for the practice of sports such as gliding sports.

Articles of footwear of the aforementioned type can be used in fields such as walking or flat or mountain racing, hiking, or snowboarding, skiing, snowshoeing, roller skating, skateboarding, cycling, ball-playing sports, or the like.

2. Description of Background and Relevant Information

An article of footwear can have a low upper or a high upper. Footwear can also be relatively flexible or, on the contrary, they can be more rigid. However, the wearer's foot, in any case, must be adequately held. Indeed, an adequate support of the foot in the upper allows the article of footwear to be put to its best use.

With a flexible low shoe, such as used for mountain running, for example, adequate support facilitates the rolling movement of the foot as well as the transmission of sensory information. In particular, the seat of the shoe, i.e., in the heel area, includes a stiffener adapted to support the wearer's heel.

The stiffener is a relatively rigid element, which surrounds the lower portion of the wearer's heel. The stiffener maintains the upper and enables the transmission of use-related impulses into the heel area. It is therefore important that the respective shapes of the stiffener and of the user's heel be complementary. However, achieving precision in this regard is rare. Indeed, there are as many foot shapes as there are users. Shoes, however, are mass-produced with standard stiffeners and, as a consequence, a standard stiffener does not adapt completely to the heel of each user. As a result, the heel is not fully supported. A clearance often remains between the user's heel and the stiffener. Therefore, small interfering heel movements can occur in the upper in the area of the shoe seat. These movements can mislead the user as to his/her perceptions, or hinder him/her during the transmission of sensory information or during the transmission of forces to a sport apparatus such as a gliding board or a roller skate, or even be the cause of injuries.

SUMMARY OF THE INVENTION

The invention improves the support of the user's heel in an article of footwear, and improves the user's comfort.

To this end, the invention is directed to an article of footwear that includes a sole and an upper, the upper including a heel seat adapted to nest the user's heel, the seat including a first stiffener.

The article of footwear according to the invention includes an arrangement that varies the manner by which the first stiffener envelops the heel seat between an expanded position, for which the size or volume of the heel seat is relatively large, and a retracted position, for which the volume of the heel seat is reduced.

The arrangement of the invention that varies the size or volume of the heel seat make it possible to adapt the stiffener to various situations. In a first situation, the heel seat volume is relatively large and enables a relative displacement of the wearer's heel with respect to the upper in order, for example, to put on or take off the article of footwear. In a second situation, the reduction in the heel seat volume allows the wearer's heel to be encircled and, as a result, substantially reduces or eliminates any possibility of relative movement of the heel with respect to the upper. The risks of injury are thus reduced, and the risks of blistering in the heel area are also eliminated.

With the arrangement for varying the heel seat size/volume, a larger stiffener surface is supported on the wearer's heel. The contact between the stiffener and the heel is closer. The stiffener adapts to the geometry of the foot and the comfort level is thus improved.

As a resulting advantage, the heel is better supported in the shoe or boot. Thus, the perceptions or transmissions of sensory information are improved. Injuries are avoided.

BRIEF DESCRIPTION OF DRAWINGS

Other characteristics and advantages of the invention will be better understood from the description that follows, with reference to the annexed drawings showing, by way of non-limiting embodiments, how the invention can be embodied, and in which:

FIG. 2 is a rear view of the shoe of FIG. 1;

FIG. 3 is a front perspective view of a first stiffener of the shoe of FIG. 1;

FIG. 4 is a front perspective view of a second stiffener of the shoe of FIG. 1;

FIG. 9 is a partial cross-section along the line IX-IX of FIG. 8;

FIG. 10 is a front perspective view of a first stiffener for a shoe according to a fourth embodiment of the invention.

DETAILED DESCRIPTION OF THE INVENTION

The first embodiment, described hereafter, relates more particularly to shoes for walking or for racing on flat or hilly terrain. However, the invention applies to other fields such as those previously mentioned.

The first embodiment is described hereafter with reference to FIGS. 1 to 6.

Figure 1:
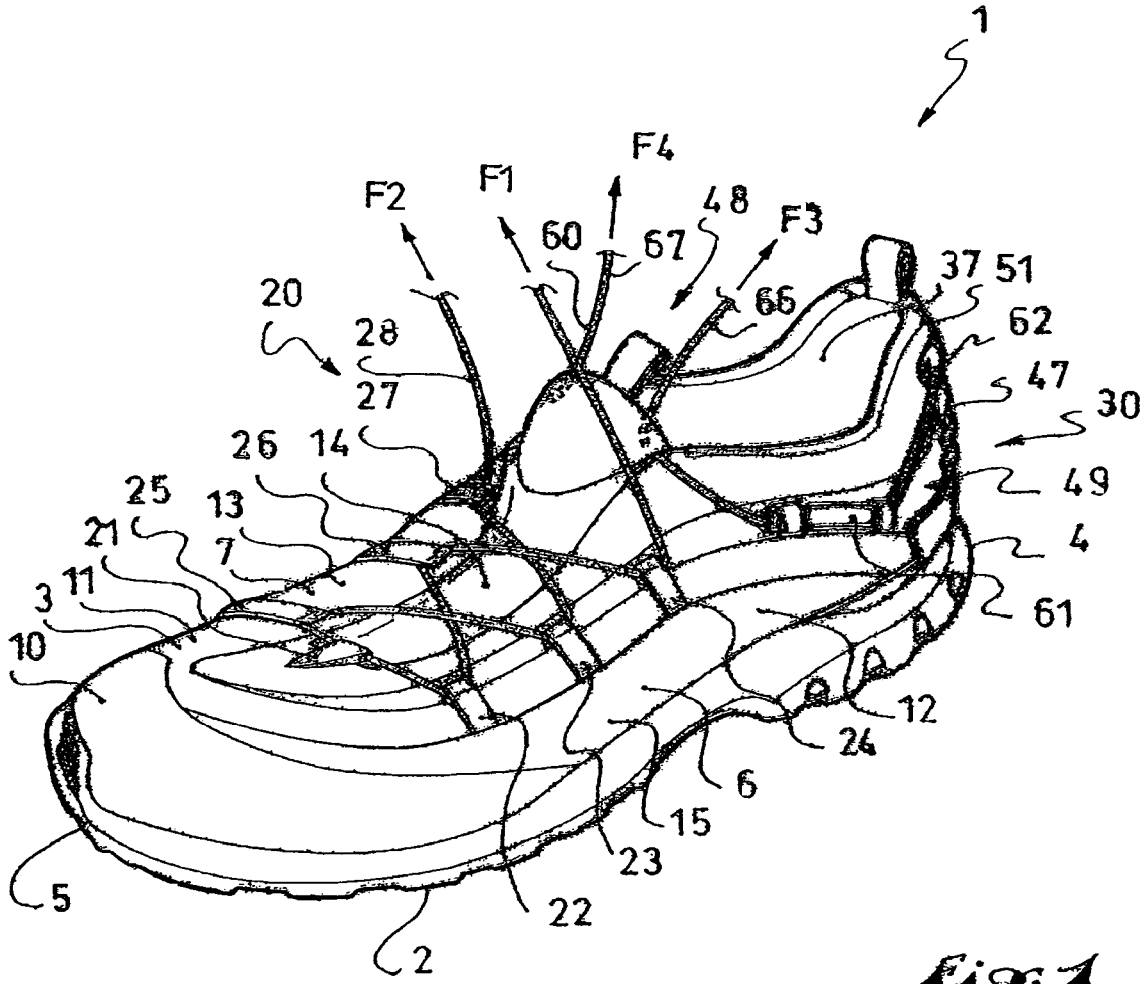
FIG. 1 is a front perspective view of a shoe according to a first embodiment of the invention.

FIGS. 1 and 2 illustrates a low cut race/running shoe 1 provided to receive the user's foot.

As is known, the shoe 1 includes an outsole 2 and an upper 3 fixed to the outsole 2. The shoe 1 extends lengthwise between a rear end or heel 4 and a front end or tip 5, and widthwise between a lateral side 6 and a medial side 7.

The upper 3, as shown, includes a low portion 10 adapted to surround the foot, with no high portion, i.e., no portion of the upper extends above the ankle. However, the upper could also be provided to include a high portion, within the scope of the invention.

The shoe 1 is structured to enable proper foot rolling movement when walking, transmission of sensory information, and impulses for support or reception. For this reason, the sole 2 and the upper 3 are relatively flexible.

However, the shoe or one of its components could also be provided to be more rigid to facilitate certain practices such as climbing or cycling.

The upper 3 includes a top portion 11, or outer cover of the upper, which has a lateral quarter 12, a medial quarter 13, and a tongue 14. The tongue 14 connects the quarters 12, 13 to one another in order to provide the top portion 11 of the upper with continuity. However, the tongue could be omitted in an embodiment within the scope of the invention. In such a case, the quarters 12, 13 can remain separated or be superimposed/overlapped.

The top portion 11 of the upper is affixed, by its base 15, to the periphery of the sole 2. The attachment is carried out by means of gluing. However, any other means, such as stitching, or a combination of gluing and stitching, could be provided.

With reference to FIG. 1, a first tightening mechanism 20 is provided for tightening and untightening the top 11 of the upper.

The first tightening mechanism 20 includes keepers 21, 22, 23, 24, 25, 26, 27 arranged on the quarters 12, 13 of the top portion 11, with the possibility for the keeper 21 to be in the vicinity of the tip 5 at the junction of the quarters.

Each keeper is shown in the form of a more or less lengthy loop associated with the top portion 11. The loop can be made of a plastic material, for example, or a fabric loop within which a plastic guide piece is positioned. Alternatively, other types of lace keepers or guides can be used.

The first tightening mechanism further includes a lace 28, which follows a path marked out by the keepers in a lacing zone. For example, the lace 28 alternately extends through a keeper of the lateral quarter 12 and a keeper of the medial quarter 13.

Other alternative lacing paths/patterns are encompassed for the lace 28 within the scope of the invention.

In any case, tensioning the lace 28 makes it possible to tighten the top portion 11 of the upper by bringing the lateral quarter 12 and the medial quarter 13 closer together. The tensioning can be carried out by any means, such as by manually applying a pulling force to the two lace segments in the direction of the arrows F1, F2, and then tying a knot, or by blocking the lace by means of a lace blocker, such as disclosed in the documents FR 2 706 743 and U.S. Pat. No. 5,477,593, or by means of other known lace blockers.

Other structures could be provided for the first tightening mechanism, such as a series of buckles controlled by levers on one side of the shoe, and hooks for receiving the buckles on the other side of the shoe.

According to the first embodiment of the invention, the shoe 1 includes a heel seat 30 adapted to nest the user's heel. The heel seat 30 includes a first stiffener 31, as shown in FIG. 3.

The general shape of the stiffener 31 is that of a crescent. The stiffener 31 includes a lateral wing 32 and a medial wing 33, each extending forwardly from a body 34. The lateral wing 32 extends partially along the lateral quarter 12, and the medial wing 33 extends partially along the medial quarter 13, the wings providing the forwardmost portions of the stiffener 31. The body 34 is in the area of the heel 4 of the shoe 1, behind the heel of the wearer.

The stiffener 31 extends height-wise of the upper 3, from the base 35, or bottom edge, up to the top edge 36. The distance between the base and the top edge is generally a few tens of millimeters, which enables the user's heel and the upper 3 to be well-supported.

Figure 5:
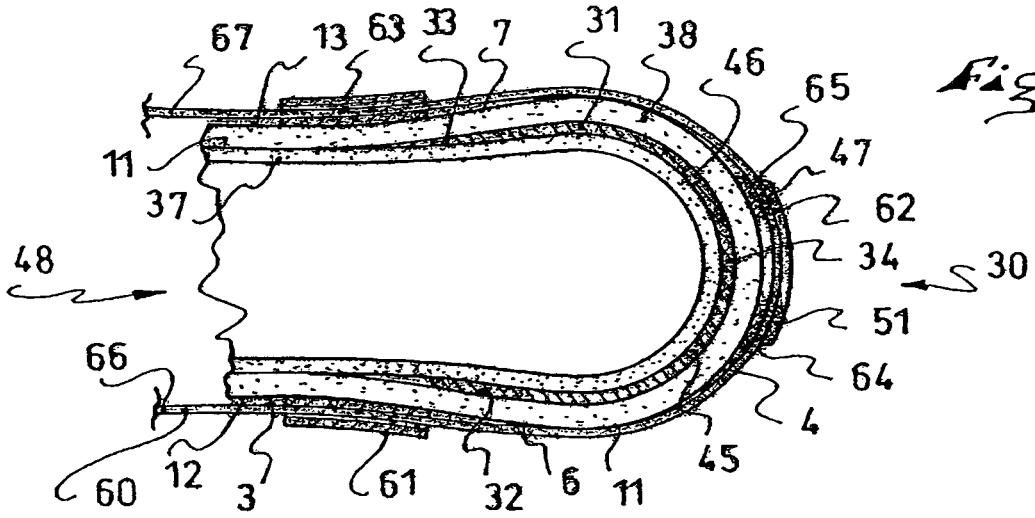
FIG. 5 is a partial cross-section of the shoe along a lace 60 of a second tightening mechanism 48, in a case where the first stiffener is in a deployed position.

As shown in FIG. 5, the upper 3 includes an inner lining 37. The stiffener 31 is located between the lining 37 and the top portion 11, inside the top portion 11, which makes its presence concealed, thereby preserving the aesthetics of the upper 3. The lining 37 provides the user with a level of comfort. Alternatively, the first stiffener 31 could be provided to be directly against the foot, or, in another embodiment, on the outside of the upper 3.

The first stiffener 31 consists of, or at least largely comprises, a substantially non-extensible and substantially rigid plastic material. This means that the first stiffener 31 naturally keeps its arched shape, which is formed during its manufacture, such as, for example, by molding, such as injection molding. This also means that the first stiffener 31 is more rigid than the upper 3, that is, more rigid than the lining 37 or the top portion 11 of the upper.

According to the invention, the article of footwear 1 includes an arrangement to vary the size or volume of the heel seat, i.e., the extent to which the first stiffener 31 envelops the heel of the wearer, i.e., between an expanded position of the first stiffener 31, for which the size or volume of the heel seat is relatively large, and a retracted position of the first stiffener 31, for which the size or volume of the heel seat is reduced.

This makes it possible to vary the space requirement of the first stiffener 31, depending upon the utilization phases of the shoe. The first stiffener 31 is in the expanded position for the purpose of putting on or taking off the shoe. Conversely, during use, the first stiffener 31 is in the retracted position. Thus, the volume of the heel seat, which is determined by the position of the first stiffener 31 is adapted to the morphology of the heel, and the heel support is adjusted at the right moment, as needed.

As shown in FIG. 3, the arrangement that enables the first stiffener 31 to vary the volume of the heel seat 30 includes, first of all, localized weakening mechanisms in the first stiffener 31. These localized weakening mechanisms can include at least one notch or, for example, two notches 45, 46. The first notch 45 is located between the lateral wing 32 and the body 34 of the stiffener. The second notch 46 is located between the medial wing 33 and the body 34. Each notch 45, 46 extends from the top edge 36 in a direction toward the bottom edge 35 of the stiffener 31, without reaching the bottom edge, however.

For example, each of the notches 45, 46 can extend halfway along the height of the stiffener 31, the height of the stiffener being measured in the area of the notch 45, 46.

The arrangement to vary the volume of the heel seat 30 by means of movement of the first stiffener 31 also includes a device for constricting the shape of the first stiffener 31. This constricting device can act directly on the first stiffener 31 or indirectly by means of a second stiffener 47.

As can be understood from FIGS. 1 to 6, the constricting device includes a second stiffener 47, on the one hand, and a second tightening mechanism 48 to reversibly tighten (i.e., to tighten and loosen) the heel seat 30, on the other hand.

According to the first embodiment, the second stiffener 47 extends around the first stiffener 31. The second stiffener 47, in the illustrated embodiment, is arranged on the outside of the upper 3, over the top portion 11. Because the first stiffener 31 is inside the top portion 11 of the upper, the top portion 11 separates the first stiffener 31 from the second stiffener 47. In an alternative variation according to the invention, the stiffeners 31, 47 can be provided to be juxtaposed and arranged either inside or outside of the upper, but in any case the second 47 extends around the first 31.

The second stiffener 47, like the first stiffener 31, includes a lateral wing 49 and a medial wing 50 that are each connected to a body 51. The stiffener 47 extends height-wise of the upper 3, from a base 52, or bottom edge, up to a top 53, or top edge. The distance between the base 52 and the top 53 is on the same order of magnitude as for the first stiffener 31.

The second tightening mechanism 48 includes a lace 60, a lateral guide 61, a rear guide 62, and a medial guide 63.

The lateral guide 61 includes an elongated keeper that is affixed to the upper 3 by any appropriate means, such as stitching, glue, or the like. Alternatively, the keeper can be integrated into the upper itself. The guide 61 can include a plurality of successive keepers. The lateral guide 61 extends outside the upper 3, substantially at the height of the top edge 36 of the first stiffener 31. The lateral guide 61 is also oriented to guide the lace in the direction of the length of the shoe 1, between the heel 4 and the tongue 14. The lateral guide 61 is oriented so that the lace 60 is caused to extend toward the tongue (i.e., toward a longitudinal vertical median plane of the shoe for an embodiment without a tongue), on the one hand, and toward the heel at the height of the top edge 36 of the first stiffener 31, on the other hand.

Figure 6:
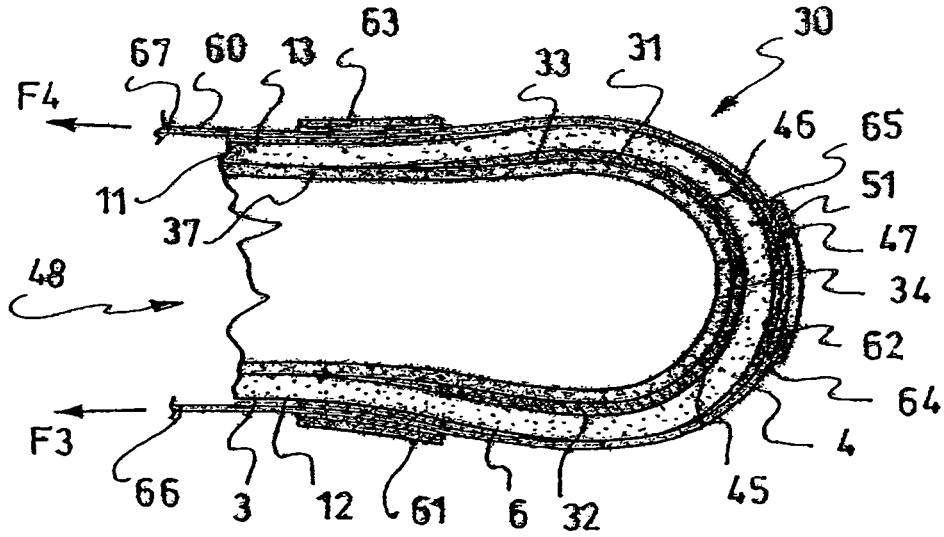
FIG. 6 is similar to FIG. 5, in a case where the first stiffener is in a retracted position.

By analogy with the lateral guide 61, the medial guide 63 comprises an extended keeper affixed to, or integral with, the upper 3. The guide 63 can comprise several successive keepers. The medial guide 63 extends outside the upper 3, substantially in the area of, or at the level of, the top edge 36 of the first stiffener 31. The medial guide 63 is also located along the length of the shoe 1, between the heel 4 and the tongue 14. The medial guide 63 is oriented so that the lace 60 naturally extends toward the tongue 14 (i.e., toward a longitudinal vertical median plane of the shoe for an embodiment without a tongue), on the one hand, and toward the heel 4 in the area of, or at the level of, the top 36 of the first stiffener 31, on the other hand. In addition to being heightwise proximate the top edge 36 of the stiffener 31, at least a portion of the lateral and medial guides 61, 63, are shown in FIGS. 5 and 6 to be positioned, lengthwise of the shoe, no farther forward than the forward ends of the wings 32, 33 of the stiffener 31.

The rear guide 62 is affixed to the second stiffener 47. More precisely, the rear guide 62 is affixed to the body 51, between the wings 49, 50, in the area of the top edge 53, "in the area" meaning at the top or in the vicinity thereof. The rear guide 62 has a lateral opening 64 and a medial opening 65 provided in the thickness of the stiffener 47. The openings 64, 65 are widened to reduce the friction on the lace 60.

Thus structured, the second tightening mechanism 48 makes it possible to tighten the upper 3 in the area of the heel seat 30, that is, around the user's ankle when the foot is supported. One only has to pull on the free ends of the strands 66, 67 of the lace 60 in the direction of the arrows F3, F4 to reduce length of the lace 60 that extends around the stiffeners 31, 47. The tightened laces can be maintained by any device, such as knotting, blocking by any appropriate device, or the like.

Pulling on the lace 60 causes the top edge 53, the body 51 of the second stiffener 47 to advance toward the tip 5 of the shoe 1. The size, or volume, of the heel seat is thereby longitudinally reduced. Given that the wings 32, 33 and 49, 50 of the stiffeners 31, 47 become progressively thin thinner in a direction toward the front, the lateral 61 and medial 63 guides of the lace 60, arranged in the area of the top edge 36, therefore toward the top of the wings 32, 33, are closer to the sole 2 than the rear guide 62. Consequently, pulling on the lace 60 toward the front and toward the sole in the area of the rear guide 62 causes the top 53 to dip toward the sole 2 at the same time as it advances. The size, or volume, of the heel seat is thereby vertically reduced. The forward bending of the body 51 of the second stiffener 47 induces the forward bending of the body 34 of the first stiffener 31. However, shortening the effective length of the lace 60 simultaneously biases the lateral 32 and medial 33 wings of the first stiffener 31 along a direction bringing them closer to one another. The size, or volume, of the heel seat is thereby transversely reduced. In general, pulling on the free ends of the strands 66, 67 of the lace 60 causes a constriction of the first stiffener 31, thereby reducing the size or volume of the heel seat. This phenomenon, due to a uniform distribution of the tension exerted by the lace, can be understood with reference to FIGS. 5 and 6.

In FIG. 5, the lace 60 is not under tension. In this case, the first stiffener 31 occupies a relatively expanded position, for which the volume provided for the heel seat 30 is relatively large, i.e., the volume around which the wings 32, 33 and body 34 of the stiffener 31 extend is relatively large. The notches 45, 46 are in their natural open slotted position.

In FIG. 6, in contrast to FIG. 5, the lace 60 is under tension. In this case, the first stiffener 31 occupies a retracted position, for which the volume provided for the heel seat 30 is reduced, i.e., the volume around which the wings 32, 34 and body 34 of the stiffener 31 extend is relatively reduced. The notches 45, 46 are tightened, in a constricted or completely closed position.

The lining 37, the top portion 11 of the upper 3, and the second stiffener 47 simultaneously follow the reversible deformations of the first stiffener 31. In other words, the volume of the heel seat 30 is varied and is adjustable. A large volume makes it possible to easily put on or take off the shoe. A reduced volume ensures that the heel is supported with little or no play. Advantageously, passing sensory information or impulses to the wearer of the shoe is facilitated, i.e., improved. Injuries are avoided due to the fact that the heel is well-supported and that a relative sliding of the heel within the shoe is eliminated. Comfort is improved due to the volume of the first stiffener 31 adapting better to the heel morphology of the particular wearer, compared to a standard stiffener of the prior art.

The first stiffener 31 is more rigid than the second stiffener 47, but an alternative could be provided within the scope of the invention, whereby it is the opposite, or the two stiffeners have the same or similar rigidity.

Other embodiments of the invention are described hereinafter with reference to FIGS. 7 to 10.

For reasons of convenience, generally only the differences with respect to the first embodiment are shown.

Figure 7:
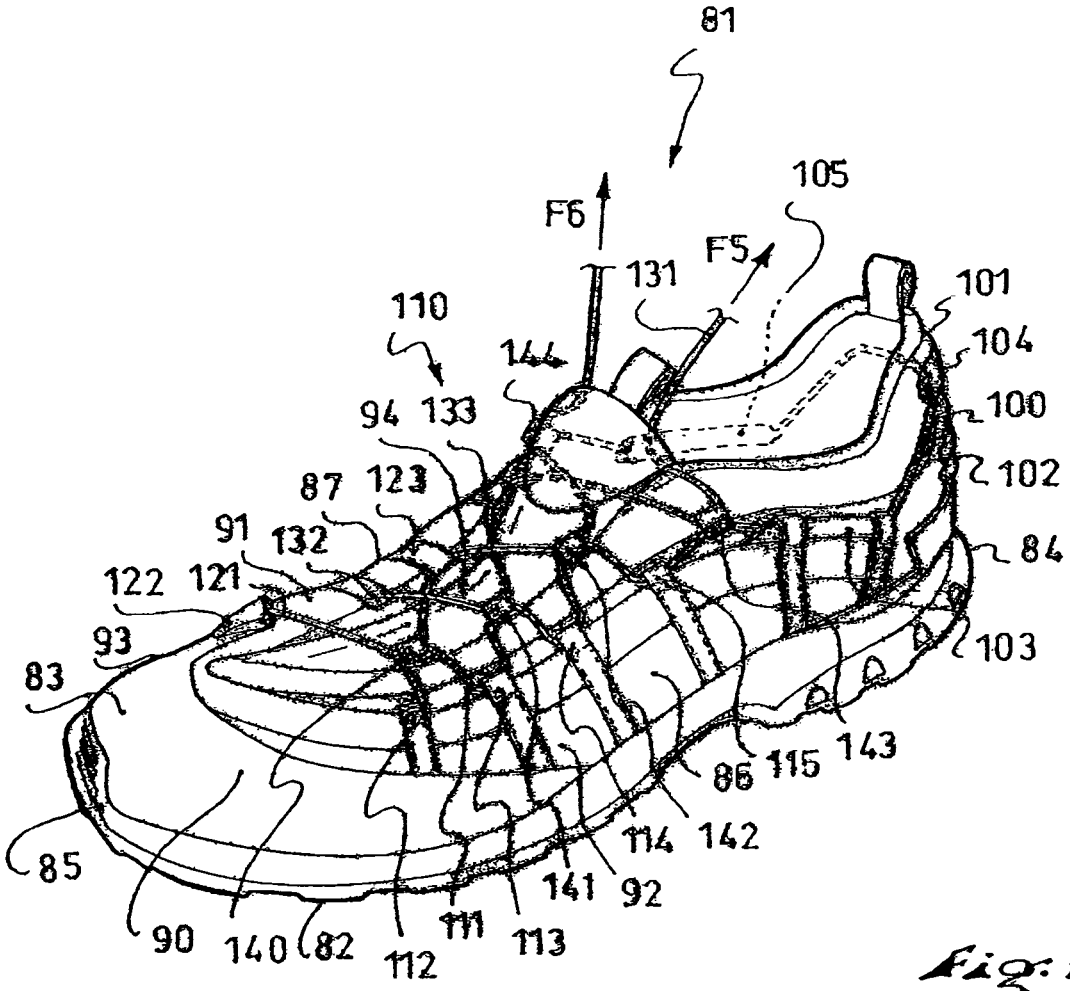
FIG. 7 is a front perspective view of a shoe according to a second embodiment of the invention.

The second embodiment is shown in FIG. 7.

As is known, FIG. 7 illustrates a shoe 81 having a sole 82, an upper 83, a heel 84, a tip 85, a lateral side 86, and a medial side 87. The upper 83 has a low portion 90 with a top 91 portion, a lateral quarter 92, a medial quarter 93, and a tongue 94.

According to the invention, the shoe 81 includes an arrangement 100 to tighten the heel seat 101. The arrangement 100 includes a constrictive lace strand 102, a lateral guide 103, a rear guide 104, and a medial guide 105. The tightening arrangement makes it possible to reversibly tighten the seat 101 of the shoe 81.

It is the arrangement 110 for tightening the top portion 91 of the upper that is particular to the shoe 81.

The tightening arrangement 110 includes a first lateral lace strand 111, which is connected to the lateral quarter 92 by a fastener 112, such as by being stitched together with a small strap, and first 113, second 114, and third 115 keepers. The fastener 112 is closer to the tip 85 than are the keepers.

The tightening arrangement 110 also includes a first medial lace strand 121, which is connected to the medial quarter 93 by a fastener 122 and a first keeper 123.

The tightening arrangement 110 also includes a second medial lace strand 131, connected to the medial quarter 93 by a fastener 132 and a first keeper 133.

A first connector 140 connects the first lateral lace strand 111 and the first medial lace strand 121 to one another. In the same context, a second connector 141 connects the first lateral strand 111 and the second medial strand 131 to one another. Also, a third connector 142 connects the first lateral strand 111 and the first medial strand 121 to one another. Each connector 140, 141, 142 enables a relative sliding of the strands 111, 121, 131. Thus, the three strands 111, 121, 131 form a mesh-like assembly, each strand having a different path, in order to make the tightening of the top portion 91 of the upper more uniform.

According to the second embodiment of the invention, the arrangement 100 for tightening the seat 101 and the arrangement 110 for tightening the top portion 91 of the upper are operatively associated. The purpose of this association is to distribute the tightening over the entire upper 83.

For this purpose, a lateral connector 143 connects the first lateral strand 111 to the constrictive strand 102, so that one extends the other and vice versa. The lateral connector 143 also receives the second medial strand 131, whereby the strand 131 slides freely within a portion of the connector 143 in the manner of a keeper. Similarly, a medial connector 144 connects the first medial strand 121 to the constrictive strand 102. The medial connector 144 enables the first medial strand 121 to slide, but it is fixedly attached to the constrictive strand 102.

Thus, the upper 83 is tightened by the application of a tension force being exerted in the direction of the arrows F5, F6 on the second medial strand 131 and on the first medial strand 121. The tightened condition can be maintained by means known to those skilled in the art. The particular arrangement of the strands 102, 111, 121, 131 provides a great uniformity in tightening. The stiffener is nested on the user's heel while the upper is tightened.

Figure 8:
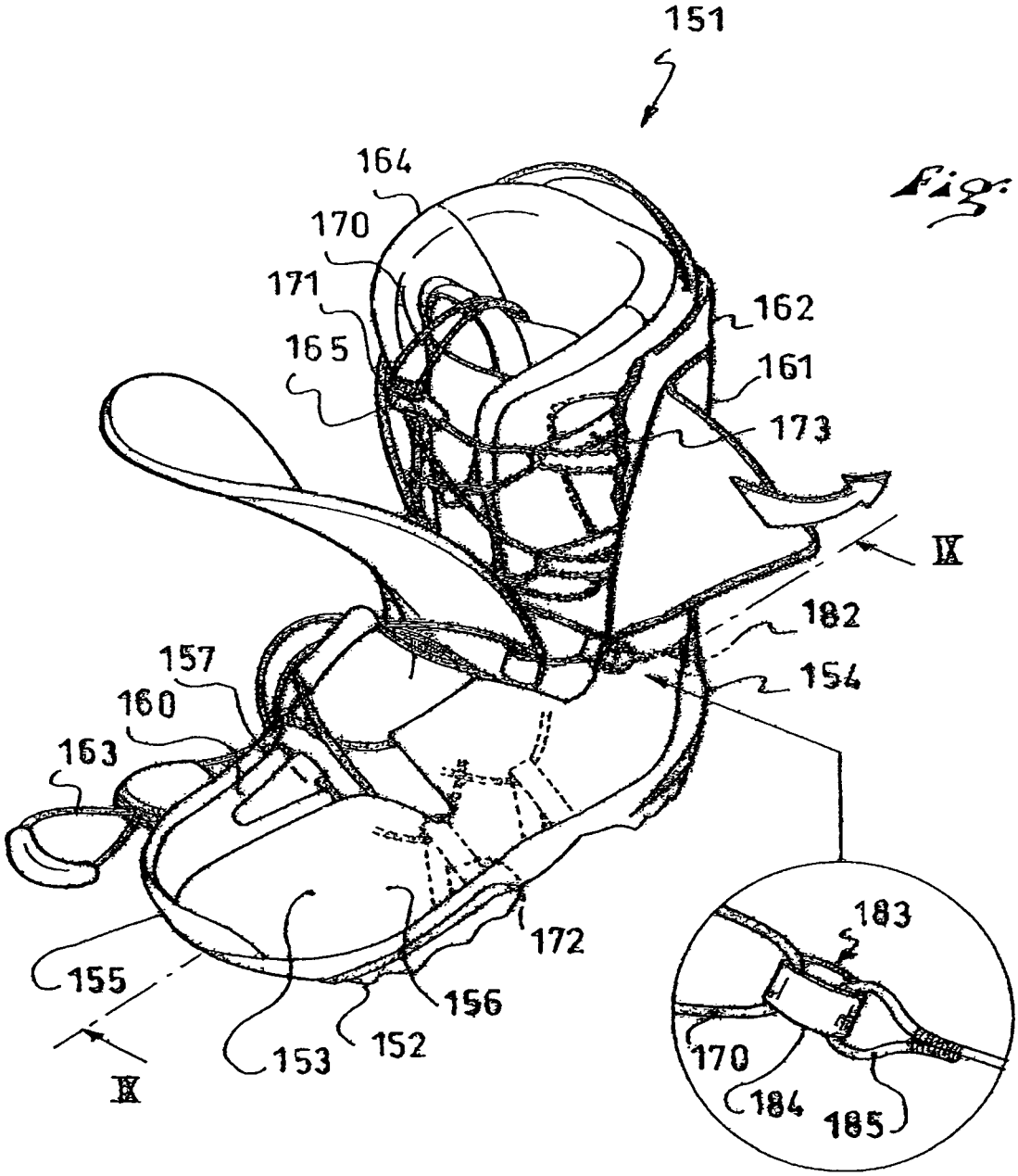
FIG. 8. is a front perspective view of a shoe according to a third embodiment of the invention.

The third embodiment of the invention is shown in FIGS. 8 and 9.

An article of footwear, i.e., a boot 151, includes a sole 152, an upper 153, a heel 154, a tip 155, a lateral side 156, and a medial side 157. The upper 153 indudes a low portion 160 adapted to cover the foot, as well as a high portion 161 adapted to surround the lower leg. In the illustrated embodiment, the shoe 151 is a snowboard boot, although this is non-limiting, whereby other types of boots that have a high upper are encompassed by the invention.

The upper 153 comprises an outer envelope 162, which can be tightened and untightened by way of a first tightening device 163. Inside the envelope 162, the upper 153 includes a liner 164, which can be tightened by way of a second tightening device 165.

In a non-limiting manner, the second tightening device 165 includes a primary lace 170, a device 171 for blocking the lace 170, low keepers 172 located in the low portion 160 of the upper, as well as high keepers 173 located in the high portion 161 of the upper. The lace 170 extends from one keeper to the next, for example, alternately from the lateral side 156 to the medial side 157.

As shown in FIG. 9, the outer envelope 162 and the liner 164 are affixed to an insole 174. The liner 164, within the scope of the invention, can be removable. The manner by which the liner is affixed can include stitching 175, for example, but could also include glue, or any equivalent arrangement or expedient. The insole 174, the outer envelope 162, and the liner 164 are affixed to the outsole 152.

According to the invention, a heel seat 180 of the upper 153 includes a first stiffener 181 as well as an arrangement to vary the manner by which the first stiffener 181 envelops the heel seat.

The first stiffener 181 is housed between the liner 164 and the envelope 162 for comfort and aesthetics purposes. Alternatively, the stiffener 181 could be housed inside the liner 164 or outside the envelope 162.

The variation arrangement includes a constrictive lace strand 182 and a device to connect the constrictive lace 182 to the primary lace 170.

As shown in FIG. 8, a lateral connector 183 connects the primary lace 170 and the constrictive lace 182. The connector 183 includes a lateral keeper 184, which slides on the primary lace strand 170, as well as a loop 185 for attaching the constrictive lace 181 to the lateral keeper 184. According to the invention, an equivalent assembly can be provided on the medial side. The tightening of the main lace 170 simultaneously causes the tightening of the constrictive lace 182. Consequently, the seat 180 is reversibly tightened at the same time as the liner 164. Alternatively, an independent tightening device could be provided for the seat, as in the first embodiment.

The fourth embodiment of the invention is shown in FIG. 10.

This embodiment is an alternative embodiment of a first stiffener 200. The stiffener 200 includes a lateral wing 201 and a medial wing 202, which extend forwardly from a body 203. The stiffener 200 extends height-wise from a base 204, or bottom edge, up to a top edge 205.

According to the invention, localized mechanisms of the stiffener 200 comprise a series of notches 211, 212, 213, 214, 215, 216 distributed along the periphery of the stiffener. There are six such notches, for example, but there could be more or fewer. There could also be only one notch. The notches extend from the top edge 205 down toward the bottom edge 204, without reaching the bottom edge. Each notch end is enlarged, for example, by a circle portion 217. This improves the mechanical strength, in the sense that incipient fractures are less likely.

In any case, the invention is made from materials and by techniques of implementation known by those of ordinary skill in the art.

The invention is not limited to the particular embodiments described above and encompasses any technical equivalents that fall within the scope of the claims that follow.

In particular, the number of stiffeners can vary; and a shoe can have one, two, or more such stiffeners.

A stiffener can be inside or outside of the upper, or can be housed between various portions of the upper.

Furthermore, in any case, a lace and or lace strand can include a cord, a string, a strap, a link, a cable, a thread, or other expedient, made of any material suitable for the purpose. The lace is therefore a link or, in a broad sense, a part of a link.

The invention claimed is:

1. An article of footwear comprising:

a outer sole;

an upper comprising:

a heel seat adapted to receive a wearer's heel;

the heel seat including a first stiffener extending from a body positioned rearward of the wearer's heel forwardly along forwardmost portions extending along a medial side of the upper and forwardly along a lateral side of the upper;

an arrangement to vary a size of the heel seat by movement of the body and the forwardmost portions of the first stiffener between an expanded position, whereby the size of the heel seat is relatively large for the wearer's heel, and a retracted position, whereby the size of the heel seat is reduced, at least longitudinally and transversely, from the size in the expanded position.

2. An article of footwear according to claim 1, wherein:

the arrangement to vary the size of the heel seat comprises:

localized weakening mechanisms of the first stiffener; and a device for constricting the first stiffener to move the first stiffener to the retracted position.

3. An article of footwear according to claim 2, wherein:

the localized weakening mechanism comprises at least one notch in the first stiffener;

the device for constricting the first stiffener includes a reversible tightening mechanism for the heel seat, the reversible tightening mechanism including a lace extending around the first stiffener, and guided by a lateral guide and a medial guide both fixed to the upper.

4. An article of footwear according to claim 3, wherein:

the reversible tightening mechanism includes a rear guide, the lateral and medial guides being closer to the sole than the rear guide.

5. An article of footwear according to claim 3, wherein:

the first stiffener comprises:

a lateral wing with a front end and an upper edge;

a medial wing with a front end and an upper edge;

the lateral guide and the medial guide are affixed to the upper, heightwise, proximate the upper edges of the lateral and medial wings, respectively; and at least a portion of the lateral guide and at least a portion of the medial guide are positioned, lengthwise, no farther forward than the front ends of the lateral and medial wings, respectively.

6. An article of footwear according to claim 2, wherein:

the forwardmost portions of the first stiffener includes a medial wing on the medial side of the upper, a lateral wing on the lateral side of the upper, the body of the first stiffener being rearward of the medial and lateral wings;

the localized weakening mechanism comprises a first notch downwardly extending between the medial wing and the body of the first stiffener, and a second notch downwardly extending between the lateral wing and the body of the first stiffener.

7. An article of footwear according to claim 2, wherein:

the localized weakening mechanism includes a series of more than two notches distributed along a periphery of the stiffener.

8. An article of footwear according to claim 2, wherein:

the device for constricting the first stiffener includes a second stiffener, said second stiffener extending around a rear of the first stiffener.

9. An article of footwear according to claim 2, wherein:

the localized weakening mechanism includes a plurality of notches downwardly extending from an upper edge of the stiffener and distributed along a periphery of the stiffener.

10. An article of footwear according to claim 1, further comprising:

an arrangement for tightening the top portion of the upper, said arrangement comprising:

a first medial lace strand connected to the medial quarter by a fastener and keepers;

a first lateral lace strand connected to the lateral quarter by a fastener and keepers;

a second medial lace strand connected to the medial quarter by a keeper;

a connector connecting the first lateral lace strand to the first medial lace strand, a connector connecting first lateral lace strand to the second medial lace strand, and a connector connecting the first lateral strand to the first medial strand;

the mechanism for constricting the first stiffener to move the first stiffener to the retracted position and the arrangement for tightening the top portion of the upper are operatively associated.

11. An article of footwear comprising:

a outer sole;

a low upper comprising:

an upper edge positioned at or below a wearer's ankle;

a heel seat adapted to receive the wearer's heel;

the heel seat including a first stiffener extending from a body positioned rearward of the wearer's heel forwardly along forwardmost portions extending along a medial side of the upper and forwardly along a lateral side of the upper;

an arrangement to vary a size of the heel seat by movement of the body and the forwardmost portions of the first stiffener between an expanded position, whereby the size of the heel seat is relatively large for the wearer's heel, and a retracted position, whereby the size of the heel seat is reduced from the size in the expanded position.

12. An article of footwear according to claim 1, wherein:

the upper is a high upper, the high upper including a low portion and high portion, the high portion extending above the ankle along a lower leg of the wearer.

13. An article of footwear according to claim 1, wherein:

in said retracted position, the size of the heel seat is additionally reduced in a direction downwardly from the size in the expanded position.

14. An article of footwear comprising:

a outer sole;

an upper affixed to the outer sole, said upper comprising:

a heel seat adapted to receive a wearer's heel;

the heel seat including a first stiffener comprising:

a body positioned rearwardly of the wearer's heel;

a medial wing extending along a medial side of the upper;

a lateral wing extending along a lateral side of the upper;

an arrangement to vary a size of the heel seat by movement of the first stiffener between an expanded position, whereby the size of the heel seat is relatively large for the wearer's heel, and a retracted position, whereby the size of the heel seat is reduced from the size in the expanded position, said arrangement comprising:

localized weakening mechanisms of the first stiffener;

a device for constricting the first stiffener to move the first stiffener to the retracted position;

the device for constricting the first stiffener comprising a second stiffener, said second stiffener being rearward of the first stiffener and extending around the first stiffener.

15. An article of footwear according to claim 14, wherein:
the localized weakening mechanism comprises at least one notch in the first stiffener;
the device for constricting the first stiffener further comprises a reversible tightening mechanism for the heel seat, the reversible tightening mechanism comprising:
a lace extending around the first stiffener; and
a lateral guide, a medial guide, and a rear guide for the lace;
the lateral and medial guides being closer to the sole than the rear guide;
the rear guide being affixed to the second stiffener.

16. An article of footwear according to claim 14, wherein:
the upper comprises an outer surface concealing the body and the medial and lateral wings of the first stiffener.

17. An article of footwear comprising:
a outer sole;
an upper comprising:
a heel seat adapted to receive a wearer's heel;
the heel seat including a first stiffener comprising:
a body constructed and arranged to be rearward of the wearer's heel;
a medial side extending from the body and along a medial side of the upper;
a lateral side extending from the body and forwardly along a lateral side of the upper;
the upper comprising an outer surface concealing the body and the medial and forward sides of the first stiffener;
an arrangement to vary a size of the heel seat by movement of the first stiffener between an expanded position, whereby the size of the heel seat is relatively large for the wearer's heel, and a retracted position, whereby the size of the heel seat is reduced from the size in the expanded position.

18. An article of footwear comprising:
a outer sole;
an upper comprising:
a heel seat having a volume for receiving a wearer's heel;
the heel seat including a stiffener having a body, a medial wing, and a lateral wing;
the body of the stiffener being structured and arranged to be rearward of the wearer's heel;
the medial and lateral wings of the stiffener extending forwardly from the body along medial and lateral sides of the upper to respective front ends of said wings, said volume of the heel seat being forward of the body of the stiffener and between the medial and lateral wings of the stiffener;
a pair of tensioning strands and at least one medial guide and at least one lateral guide affixed to, or integral with, the medial and lateral surfaces of the upper for guiding the tensioning strands relative to said guides;
said tensioning strands extending from a position rearward of the stiffener forwardly to the medial and lateral guides and, from the medial and lateral guides proximate upper edges of the medial and lateral wings of the stiffener, inward toward a longitudinal vertical median plane of the article of footwear;
said stiffener having an expanded volume state to facilitate entry and withdrawal of the wearer's heel relative to the heel seat, and a constricted volume state to reduce or eliminate movement of the wearer's heel relative to the upper;
in said expanded state, said pair of tensioning strands having a reduced tension;
in said restricted state, said pair of tensioning strands having a tension greater than said reduced tension.

* * * * *